United States Patent [19]

Naeve

[11] 3,983,593

[45] Oct. 5, 1976

[54] CONDUIT CLEANING APPARATUS

[76] Inventor: Lester H. Naeve, 3504 Parker Road, Fort Worth, Tex. 76117

[22] Filed: Sept. 18, 1975

[21] Appl. No.: 614,412

[52] U.S. Cl. ..... 15/104.3 SN; 226/147; 254/134.3 FT

[51] Int. Cl.[2] ..... B08B 9/02

[58] Field of Search ..... 15/104.16, 104.3 R, 15/104.3 SN; 242/54; 254/134.3 FT; 226/147

[56] References Cited

UNITED STATES PATENTS

| | | | |
|---|---|---|---|
| 3,083,391 | 4/1963 | Prange | 15/104.3 SN |
| 3,703,015 | 11/1972 | Naeve | 15/104.3 SN |

*Primary Examiner*—Edward L. Roberts

*Attorney, Agent, or Firm*—Wofford, Felsman, Fails, & Zobal

[57] ABSTRACT

Conduit cleaning apparatus characterized by a reel of cable and a pair of rachet gripping members for feeding the cable through. A rearward gripping member is mounted stationary with respect to the reel. A forward gripping member is carried forwardly thereof by telescoping guide structure that aligns the gripping members along the axis of rotation of the reel and allows reciprocal motion between the gripping members. The rachet gripping members advance or retract the cable. A spring urges the members apart to facilitate reciprocation while in a vertical position.

12 Claims, 4 Drawing Figures

CONDUIT CLEANING APPARATUS

BACKGROUND OF THE INVENTION

1. Field of the Invention

This invention relates to conduit cleaning apparatus, more particularly to an apparatus utilizing a reel of cable for feeding through sewer and drain pipes.

2. Description of the Prior Art

There are various types of rotary cable carrying reels for cleaning out conduits such as sewers, drain pipes, and the like. One such device is described in my patent, U.S. Pat. No. 3,703,015, issued Nov. 21, 1972. The device described therein utilizes rachet gripping means for effecting advancement of the cable into the conduit. A supporting frame and base allow the reel and one rachet gripping means to reciprocate with respect to the other ratchet gripping means.

While the device described therein is successful, smaller and lighter devices are desirable. Certain conduits are accessible from a vertical pipe; in which case it is desirable to have the cable entering from substantially a vertical angle. Many conduit cleaning devices are too heavy and awkward to stand on end in a vertical angle and lack the guide means for guiding the cable into a vertical conduit. Also, if using a device having ratchet gripping means as described in my patent, reciprocation up and down would be strenuous because of the need to lift the entire reel and cage means.

SUMMARY OF THE INVENTION

Accordingly it is an object of this invention to provide an improved conduit cleaning apparatus. It is a further object to provide an improved conduit cleaning apparatus that is lightweight and may easily be used in a vertical position. These and other objects will be apparent from the descriptive matter and drawings set forth hereinafter.

In accordance with these objects, a telescoping guide means is provided between the rachet gripping members. The guide means has a pair of tubular members mounted in sliding, telescoping relationship, thus providing alignment for the gripping members and allowing reciprocation. A spring is carried within the telescoping members to bias the members apart, facilitating lifting the reed during reciprocation. Consequently platform and supporting members are not necessary. A second embodiment eliminates a separate cage for containing the reel.

DESCRIPTION OF THE PREFERRED EMBODIMENT

Figure 1:
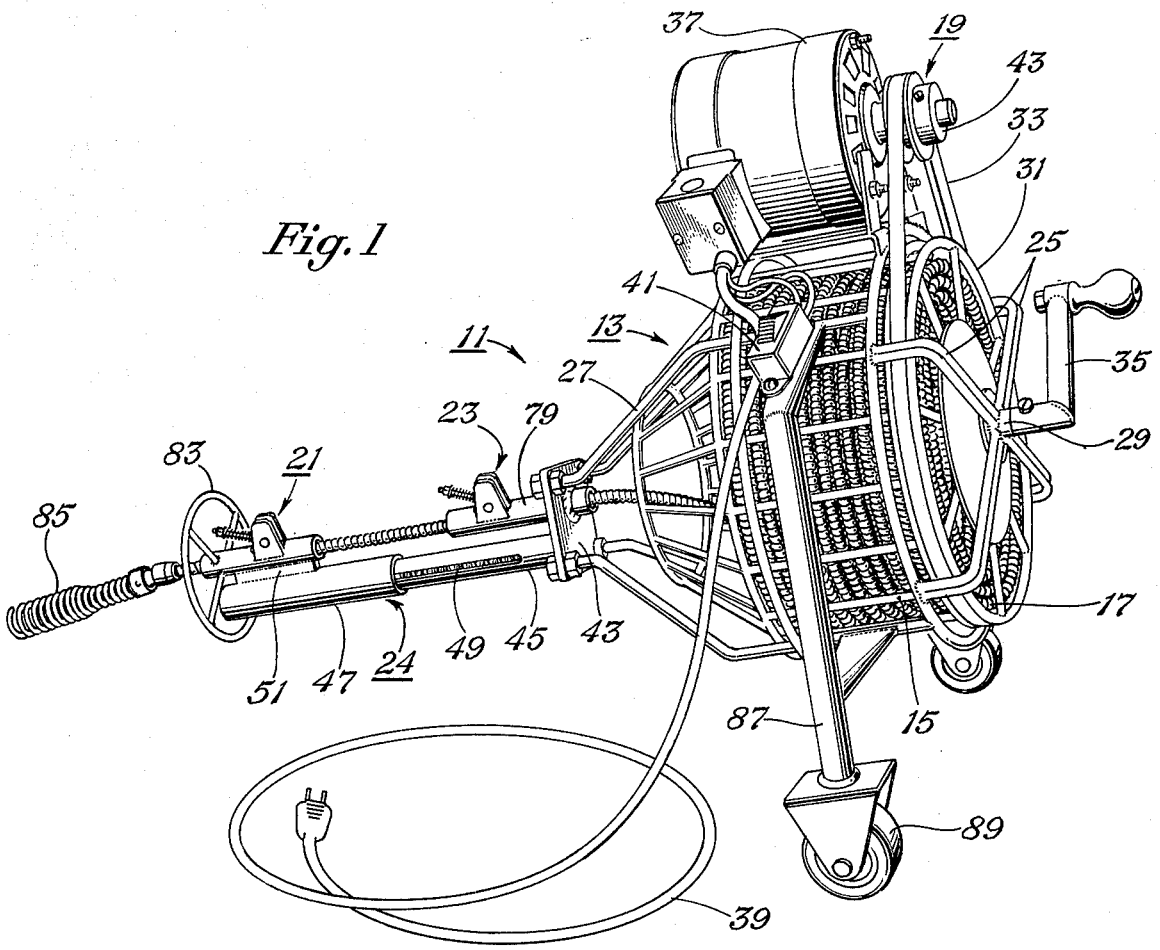
FIG. 1 is an isometric view of one embodiment of this invention.

Referring to FIG. 1, the conduit cleaning apparatus 11 comprises the major sub-assemblies or elements of cage means 13 for containing a reel 15 of cable 17, rotating means 19 for rotating the cage means, first and second rachet gripping means 21 and 23 for allowing a predetermined relative movement and blocking against other predetermined relative movement between the cable and gripping means, and guide means 24 for aligning the rachet gripping means and for allowing reciprocable motion therebetween.

Cage means 13 is comprised of bars connected together to define a cylindrical shape with a flat rearward end 25 and a frusto conical forward end 27. The rearward end 25 has a hub 29 for carrying reel 15. Reel 15 is mounted inside cage means 13 on a shaft (not shown) which is journaled in hub 29. Accordingly reel 15 will rotate with respect to cage 13. Reel 15 has a driving rim 31 adapted to fit the particular element employed in the driving assembly. For example, it may be gear if a gear drive is employed, a sprocket if a chain drive is employed, or a rim for receiving a belt 33 if a belt drive is employed, as illustrated.

The rotating means 19 may comprise a simple handcrank 35 fastened to the shaft for manually rotating reel 15. The rotating means 19 may also comprise a power drive assembly comprising an electric motor 37 mounted to cage means 13 and connected via electric cord 39 to a source of electric power. A switch 41 controls the electric motor 37, and a pulley 43 receives belt 33. Ordinarily, the manually operable crank 35 and shaft will be adequate as the rotating means and the cost- and weight-increasing motor 37, switch 41, driving rim 31 and accessories need not be employed.

The forward end 27 of the cage means 13 converges to a point substantially in alignment with the axis of rotation of reel 15. The bars of the cage means 13 are bolted to a bracket 43 to which the second rachet gripping means 23 is welded. Guide means 24 is a telescoping guide structure having one end welded to bracket 43 adjacent the second rachet gripping means 23, and extending forwardly parallel to a line coinciding with the axis of rotation of reel 15. Guide means 24 has two members, rearward member 45 and forward member 47, that are tubular and fit together in a telescoping relationship. Rearward member 45 is smaller than forward member 47 and fits slidingly within. A coil spring 49 is carried inside the hollow members to bias the members apart. There is a stop (not shown) within the members 45, 47 to prevent separation when fully extended.

The second rachet gripping means 23 is welded by means of a web 51 to the forward telescoping member 47 in alignment with the first rachet gripping means 23. Consequently the second rachet gripping means is stationary with respect to the reel 15, cage means 13, and rearward telescoping member 45, while the first rachet gripping means is stationary with respect to the forward telescoping member 47. The rachet gripping means 21 and 23 are thus movable with respect to each other along a line coinciding with the axis of rotation of reel 15.

Figure 2:
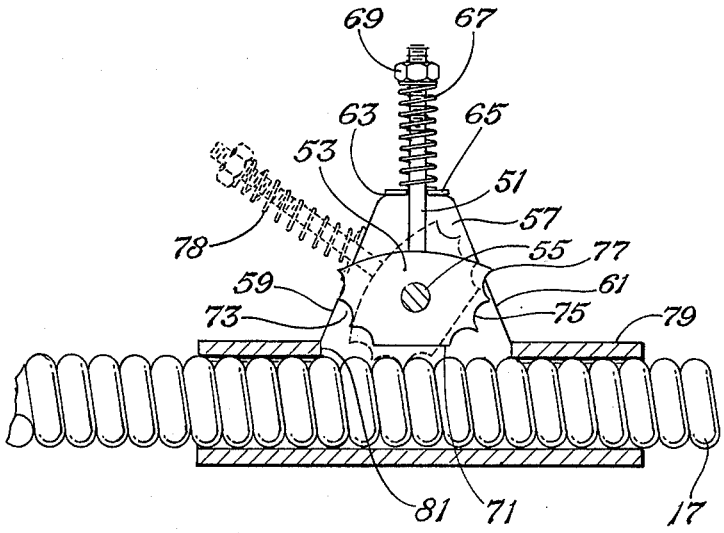
FIG. 2 is a partial elevational view, partly cut away and sectional, illustrating a rachet gripping means for the embodiments of FIG. 1 and FIG. 4, described hereinafter.
Figure 3:
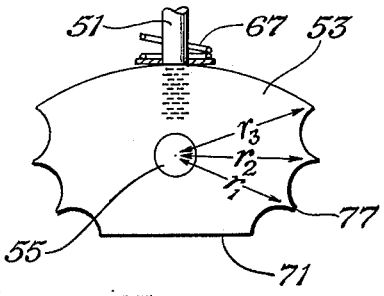
FIG. 3 illustrates a partial side elevational view of the handle and holding means of the rachet gripping means of FIG. 2.

The rachet gripping means 21 and 23 are described in my patent, U.S. Pat. No. 3,703,015. As illustrated in FIGS. 2 and 3, each of the first and second rachet gripping means has handles 51 and holding means 53 for determining whether or not the respective rachet gripping means will grip and hold the cable and in what direction of relative movement against which the respective rachet gripping means will hold. The handle 51 and holding means 53 are mounted for pivotal movement about a mounting shaft 55. The mounting bracket 57 has two sides with handle 51 between and is illustrated in FIG. 2 with one side cut away. Bracket 57 serves as a cam surface having two respective edge surfaces 59 and 61 and top surface 63 that co-act with biased cam follower means 65 for maintaining the handle and holding means in a set position. Specifically, the cam follower means 65 may comprise a washer that is biased by suitable spring 67 to retain the handle 51 and holding means 53 in a set position; that is, on either side, or at the neutral, or upright position. Compression of the spring may be adjusted by tightening or loosening nut 69 on handle 51.

The holding means 53 has a neutral portion, illustrated as flat bottom portion 71; and, on either side of the neutral portion, respective rachet portions 73 and 75. As illustrated clearly in FIG. 3, each rachet portion has respective rachet pawls 77 that have respectively increasing radii $r_1$, $r_2$ and $r_3$ that increase as the distance of the pawl from the neutral portion increases. Expressed otherwise, the radius $r_3$ is larger than the radius $r_2$ which is also greater than the radius $r_1$ such that the rachet portion will grip the cable when the cable tries to move in one direction with respect to the rachet gripping means. For example, it can be seen that in FIG. 2 that, with the handle moved to the left, as illustrated by the dashed lines 78, the rachet gripping means will allow the cable to move to the left, but will grip the cable and prevent its movement to the right. Conversely if the handle is moved to the right in FIG. 2, the cable will be allowed to move to the right but will be gripped when it is attempted to move to the left. In the center position, however, as illustrated, it can be seen that the flat bottom surface 71 does not contact the cable and allows free rotation of the cable, as for cutting roots and the like in a drain or sewer line.

The mounting bracket 57 is welded to a tubing member 79 through which cable 17 passes. An elongated aperture 81 is cut between the sides of bracket 57 to provide access to the cable for the holding member 53. A circular web or flange 83 is welded to the tubing member 79 of the first rachet gripping means 21. Flange 83 is to be placed over the mouth of conduit while in the vertical position, thereby supporting the conduit cleaning apparatus.

A pair of legs 87 with wheels 89 are fastened to the cage means 13. The legs and wheels serve a multiplicity of purposes. First, they facilitate transporting the conduit cleaning apparatus 11. Second, they facilitate reciprocal movement if employed with horizontal or angled entry of the cable. Moreover, the legs are used to prevent rotation of the cage means 13 when the reel 15 and cable 17 are rotated; for example, manually.

Reel 15 and cable 17, along with its cleaning element 85 are conventional.

In operation, flange 83 is placed against the mouth of, or entry to, the conduit to be cleaned and cable 17 is fed in while reel 15 is rotated. The respective handles of the first and second rachet gripping means 21 and 23 are moved to the forward position as shown by the dotted line 78 at FIG. 2. Cage means 13 and consequently the second rachet means and cable are pushed forward. Telescoping member 45 slides into telescoping member 47, compressing spring 49. Since the tendency for relative movement is for the second rachet gripping means 23 to move to the left, its holding means 53 grips the cable and pushes the cable forwardly as the cage means 13 is pushed forwardly. On the other hand, the first rachet gripping means allows the cable to move to the left without gripping it. After desired forward movment of the reel has been affected, the cage means 13, assisted by spring 49, is moved rearwardly. During this movement, the respective relative motions are reversed; that is, the cable 17, tends to move to the right with respect to the first rachet gripping means 21. The first rachet gripping means 21 therefore holds the cable and prevents it from moving to the right. On the other hand, the second rachet gripping means 23 now perceives the relative motion as a movement of the cable to its left as it is moved to the right, or rearwardly. Consequently, it releases the cable and allows itself to be moved over the cable without gripping the cable. When an obstruction is encountered, the rachet gripping means may be moved to the center to allow free rotation; or they may be left in position and rotation tends to advance the cable into the conduit incrementally as the obstacle is cleared away, or cleaned from the conduit.

After the conduit has been cleaned for the desired distance, the cable is rewound by reel by movement of the rachet gripping means to the right. Again, cage means 13 is moved reciprocably to effect rewinding of the cable. In the rewinding operation, however, the operation of the respective rachet gripping means is reversed. Specifically, the rachet portion 75 is in placed adjacent the cable 17. Consequently, during a forward movement or movement to the left in FIG. 1, the first rachet gripping means 21 will grip the cable and prevent its movement, whereas the second rachet gripping means 23 will slip over the cable. On the reverse stroke, or movement to the right, however, the first rachet gripping means 21 will allow the cable to move to the right therethrough, whereas the second gripping means 23 will grip the cable, and pull the cable to the right as the cage means 13 is moved to the right. After the termination of the movement to the right, and during the movement to the left, the cable is coiled into reel 15 and the respective rachet gripping actions reversed, as described with respect to the first movement to the left during retraction, or rewinding, of the cable 17.

Figure 4:
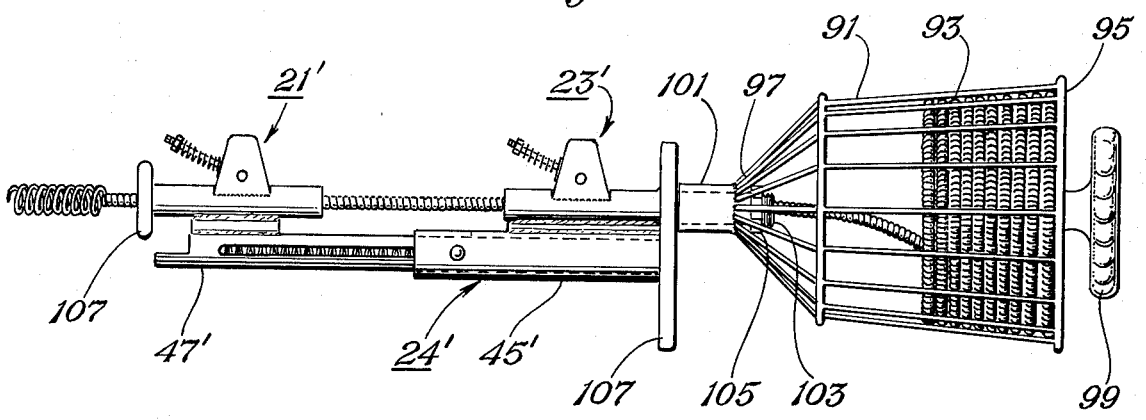
FIG. 4 is a side elevational view of another embodiment of this invention.

Another embodiment of my invention is shown in FIG. 4. The conduit cleaning apparatus according to this embodiment is smaller and lighter than the one shown in FIGS. 1–3, and is intended for manual rotation. A reel 91 containing cable 93, has a flat rearward end 95 and a frusto conical forward end 97. The rearward end has a handle or wheel 99 for rotation means. The forward end of the reel is welded to a hollow hub 101. Hub 101 is journaled to a shaft 103 and held by a nut 105 screwed onto a threaded end of the shaft. Shaft 103 is tubular with an inner bore for the passage of cable 93.

The forward end of shaft 103 is welded to a flange 107. On the opposite side of flange 107. a guide means 24' is fastened and aligned along the axis of rotation of the reel 95. Guide means 24' is of the same general configuration and function as described hereinbefore concerning guide means 24. Forward member 47' is shown as being larger and receiving rearward members 45'. This is opposite to FIG. 1, but either position is satisfactory. First and second rachet gripping means 21' and 23' are fastened to the telescoping members of the guide means. The first and second rachet gripping means are of the configuration and function as previously described concerning rachet gripping means 21 and 23. A rubber flange 109 is fastened to the first rachet gripping means 21' and functions as did steel flange 83 of the other embodiment. Flange 107 serves as a mounting bracket similar to bracket 43 in FIG. 1. Flange 207 extends outwardly for additionally providing a bracing against an operator's knee whild rotating the conduit cleaning apparatus. No cage means or legs are utilized in the embodiment of FIG. 4.

While the members 47 and 49 have been described as tubular in order to most easily effect telescoping, or reciprocal, movement, any other form of telescoping members can be employed if desired.

From the foregoing descriptive matter, it can be seen that this invention provides apparatus that accomplishes the objects delineated hereinbefore. Both embodiments are small and lightweight. They may easily be placed in a vertical position, if desired, or used at other angles. The spring facilitates the reciprocating movement.

Although the invention has been described with a certain degree of particularity, it is understood that the present disclosure has been made only by way of example and that numerous changes in the details of construction and combination and arrangement of parts may be resorted to without departing from the spirit and the scope of the invention. Moreover, obvious equivalents may be substituted for the specific elements and mechanical devices described.

What is claimed is:

1. A conduit cleaning apparatus comprising: a reel of cable;

rotating means for rotating the reel of cable;

first and second rachet gripping means, the second rachet gripping means being carried so as to be stationary with respect to the reel; the first rachet gripping means being carried forwardly of and movable with respect to the first rachet gripping means; said first and second rachet gripping means having movable holding means for determining whether or not said rachet gripping means will grip and hold said cable and in what direction of relative movement against which they will hold;

guide means connected between the first and second rachet gripping means for aligning the first and second rachet gripping means and for allowing reciprocal movement therebetween; and bias means connected between the first and second rachet gripping means for urging the first and second rachet gripping means apart.

2. The apparatus of claim 1 wherein the guide means comprises a pair of tubular members, one carried within the other in a sliding and telescoping relationship therewith; each member being attached to one of the rachet gripping means.

3. The apparatus of claim 2 wherein the bias means comprises a coil spring carried within the tubular members.

4. Conduit cleaning apparatus comprising:

a cage means for containing a reel of cable;

a reel connected to the cage means and containing cable for extending the cleaning device into the conduit;

rotating means for rotating the reel of cable;

a telescoping guide structure having a rearward member rigidly connected and stationary with respect to the cage, and a forward member, movable in telescoping relationship with respect to the cage;

first and second rachet gripping means, the first ratchet gripping means being carried stationary with respect to the forward member of the telescoping guide structure, and the second rachet gripping means being carried stationary with respect to the rearward member of the telescoping guide structure; said first and second rachet gripping means having movable holding means for determining whether or not said rachet gripping means will grip and hold said cable and in what direction of relative movement against which they will hold.

5. The apparatus of claim 4 further comprising bias means connected between the rearward and forward members of the telescoping guide structure to urge the members apart.

6. The apparatus of claim 5 wherein the forward and rearward members of the telescoping guide structure are tubular, and the bias means comprising a spring carried within the members.

7. The apparatus of claim 6 further comprising a flange mounted to the forward member of the telescoping guide structure for mating with the mouth of the conduit while in vertical position.

8. A conduit cleaning apparatus comprising:

a reel containing cable for extending a cleaning device into the conduit;

rotating means attached to the reel for rotating the reel;

a telescoping guide structure, having a rearward member rotatably mounted to the reel, a forward member extending forwardly from the rearward member and mounted in sliding and telescoping engagement therewith; and first and second rachet gripping means, the first rachet gripping means being carried stationary with respect to the forward member and the second rachet gripping means being carried stationary with respect to the rearward member; said first and second rachet gripping means having movable holding means for determining whether or not said rachet gripping means will grip and hold said cable and in what direction of relative movement against which they will hold.

9. The apparatus of claim 8 further comprising bias means connected between the forward and rearward members of the telescoping guide structure to urge the members apart.

10. The apparatus of claim 9 wherein the forward and rearward members of the telescoping guide structure are tubular and the bias means comprises a spring carried within the members.

11. The apparatus of claim 10 further comprising a flange connected to the forward member for mating with the opening of the conduit while in vertical position.

12. The apparatus of claim 11 further comprising an outwardly extending flange connected to the rearward member for bracing against an operator's knee while using the conduit cleaning apparatus in a vertical position.

* * * * *